US005522542A

United States Patent [19]

Ciecielski

[11] Patent Number: 5,522,542

[45] Date of Patent: Jun. 4, 1996

[54] ELASTIC FASTENING CLAMP IN SHAPE OF A DOUBLE C

[76] Inventor: Ezildo Ciecielski, Polonia Street, 585, Cachoeirinha, Brazil

[21] Appl. No.: 256,222

[22] PCT Filed: Oct. 22, 1993

[86] PCT No.: PCT/BR93/00037

§ 371 Date: Nov. 30, 1994

§ 102(e) Date: Nov. 30, 1994

[87] PCT Pub. No.: W094/10382

PCT Pub. Date: May 11, 1994

[30] Foreign Application Priority Data

Oct. 23, 1992 [BR] Brazil ..... 9204140

[51] Int. Cl.[6] ..... E01B 9/34

[52] U.S. Cl. ..... 238/352; 238/349

[58] Field of Search ..... 238/349, 351, 238/352

[56] References Cited

U.S. PATENT DOCUMENTS

| | | | |
|---|---|---|---|
| 2,954,169 | 9/1960 | Rigby | 238/351 |
| 3,724,754 | 4/1973 | Molyneux et al. . | |
| 4,284,238 | 8/1981 | Veroef | 238/351 |
| 4,778,106 | 10/1988 | Diener et al. | 238/351 |

FOREIGN PATENT DOCUMENTS

| | | | |
|---|---|---|---|
| 450012 | 6/1972 | Australia . | |
| 1146086 | 3/1963 | Germany . | |
| 1253297 | 11/1967 | Germany . | |
| 7807736 | 1/1980 | Netherlands . | |
| 388360 | 6/1965 | Switzerland . | |
| 82200669 | 3/1982 | WIPO | 238/351 |

*Primary Examiner*—Robert J. Oberleitner
*Assistant Examiner*—S. Joseph Morano
*Attorney, Agent, or Firm*—Darby & Darby

[57] ABSTRACT

A unitary clamp adapted to fit in a part circular opening defined by two arcuate arms having a gap between their opposing ends that are formed on a vertical upstanding wall of a clamp plate having a base for resting on a sleeper in which the base of the clamp plate is to carry a rail that is parallel to the clamp plate upstanding wall and the clamp is to fit in the part circular opening and engage both the clamp plate and the rail. The clamp has a unitary member of two generally C shaped sections each having upper and lower curved arms joined by a central member, and a cross-connecting piece at the end of the central member at one of said upper and lower arms of each of the two sections to place the sections spaced apart and generally parallel to each other. The cross-connecting piece has a curved shape conforming to that of the part circular opening to engage the interior of the two arcuate arms of the clamp plate upstanding wall part circular opening, with one of the arms of the two clamp sections resting on the clamp plate base and the other arm of the clamp sections to rest on the rail.

4 Claims, 5 Drawing Sheets

FIG. 4A
(PRIOR ART)
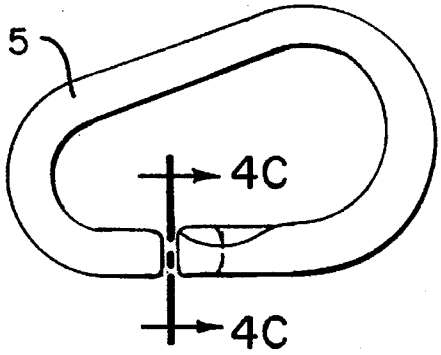
FIG. 4C
(PRIOR ART)
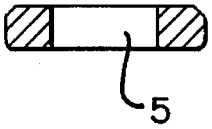
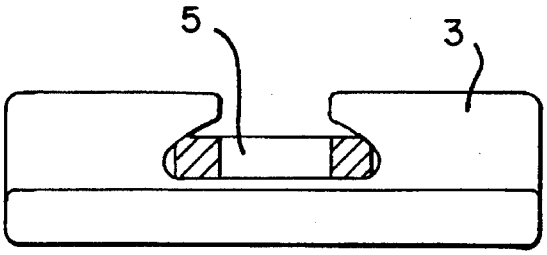
FIG. 4B
(PRIOR ART)
FIG. 5A
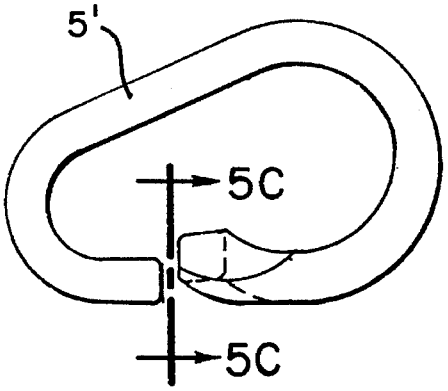
FIG. 5C
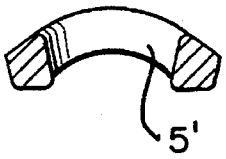
FIG. 5B
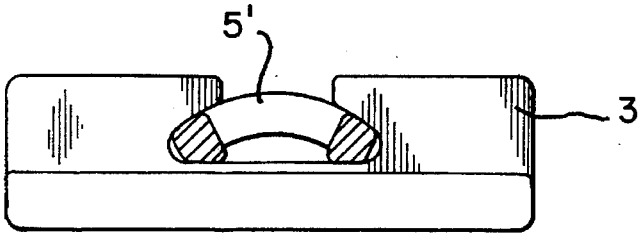

ELASTIC FASTENING CLAMP IN SHAPE OF A DOUBLE C

BACKGROUND OF THE INVENTION

This invention covers an improvement in an elastic fastening clamp in form of a double C. Such clamp has the purpose of fastening the rail of a railroad track to a support or sleeper.

These clamps are technically known as DEENIK clamps and they are fixed on a fastening plate which is screwed, say on wooden sleepers, by means of bolts know as tirefons.

One serious inconvenience of this type of clamps is the violent wear suffered by the parts of contact between the clamp and the plate, resulting into an appreciable decrease in the useful service life of the plate.

BRIEF DESCRIPTION OF THE INVENTION

The purpose of the invention is to modify the surface of contact between the clamp and the plate by changing the shape of the clamp basis which becomes an arc, having approximately the same radius as the notch of the plate whose surface is a half circle.

This improvement in the invention has the advantage that now there is a perfect adjustment between the clamp and the plate, and contact between these two pieces is no longer by points, as was the case with the conventional clamp, but involves the entire surface of the notch in the plate. Furthermore the system proposed by this invention gives more stability to the clamp and plate set and greater resistance to longitudinal displacement since the rotatory movement of the clamp around its own axis will become more difficult.

A better understanding of this invention will be obtained by referring to the attached drawings, where:

BRIEF DESCRIPTION OF THE DRAWINGS

FIGS. 4A–4C are, respectively views of a conventional clamp, a transverse section of its basis and a cross section (along line 4C—4C in FIG. 4A and looking in the direction of the arrows) showing the adjustment of the clamp basis to the fastening plate.

FIGS. 5A–5C are, respectively, views of a clamp according to the invention a transverse section of its basis and a cross section (along line 5C—5C in FIG. 5A and looking in the direction of the arrows) showing the adjustment of the clamp basis to the fastening plate.

FIGS. *6a–6c* is left side, top, and front views of a prior art clamp.

FIGS. *7a–7c* is the same left side, top and front views of the clamp according to the invention.

Figure 3A:
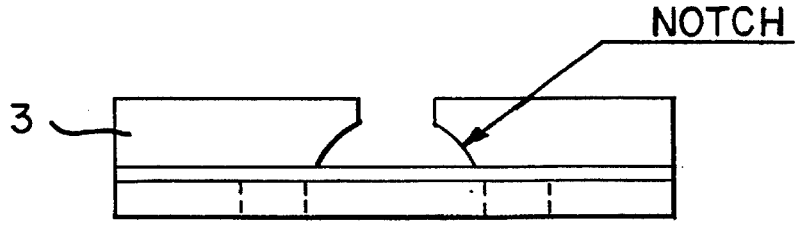
FIGS. 3A and 3B are, respectively, a horizontal plane and a vertical plane of the fastening plate showing the notch in such plate.
Figure 3B:
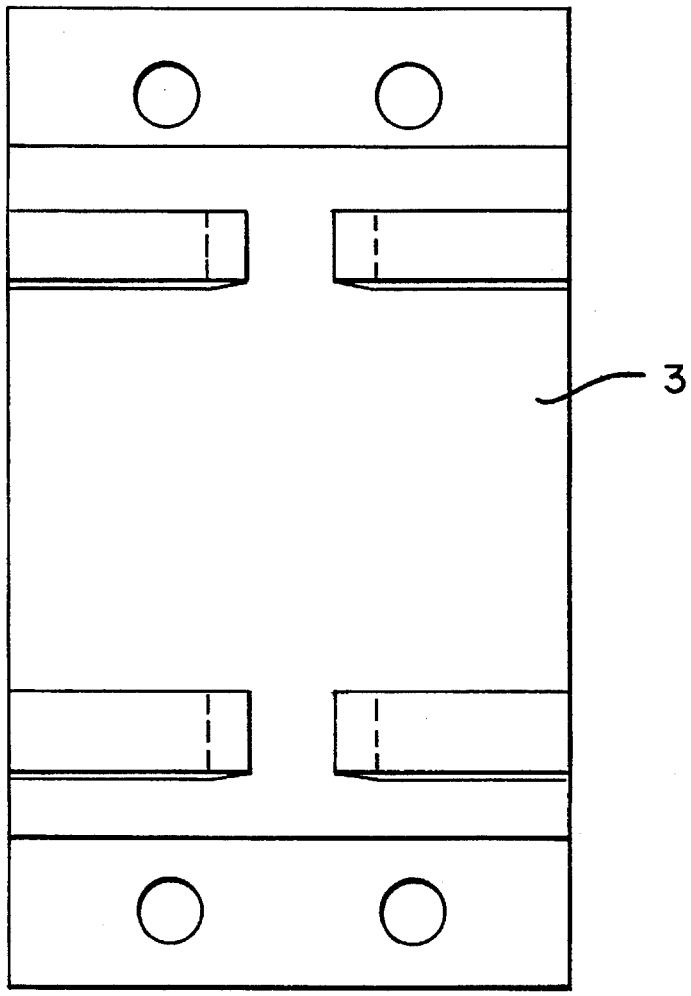
Figure 6A:
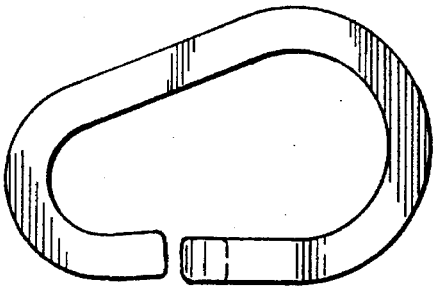
FIG. 6A (PRIOR ART)
Figure 6C:
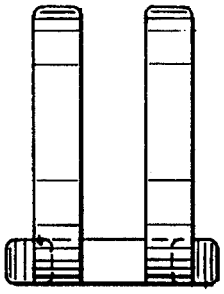
FIG. 6C (PRIOR ART)
Figure 6B:
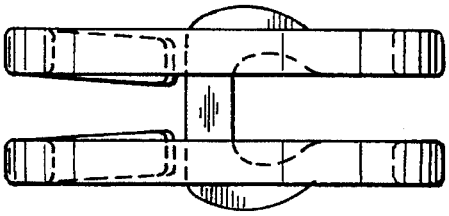
FIG. 6B (PRIOR ART)
Figure 7A:
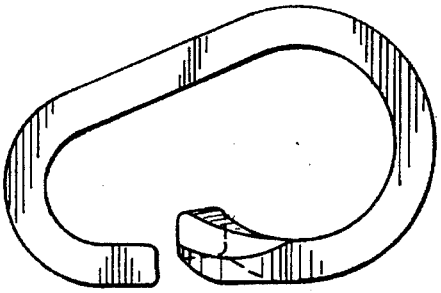
Figure 7B:
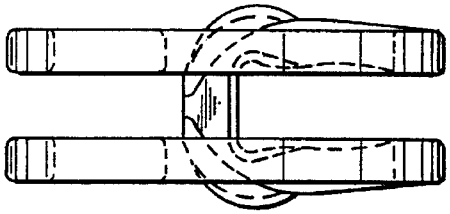
Figure 7C:
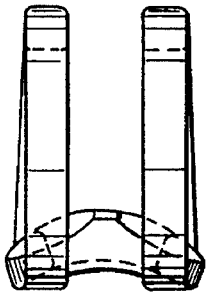

In some instances below, groups of figures will be referred to collectively by a single number. For example, FIGS. 3A–3B may be referred to as FIG. 3, FIGS. 4A–4C may be referred to as FIG. 4, FIGS. 5A–5C may be referred to as FIG. 5, FIGS. 6A–6C may be referred to as FIG. 6, and FIGS. 7A–7C may be referred to as FIG. 7.

DETAILED DESCRIPTION OF THE INVENTION

Figure 1:
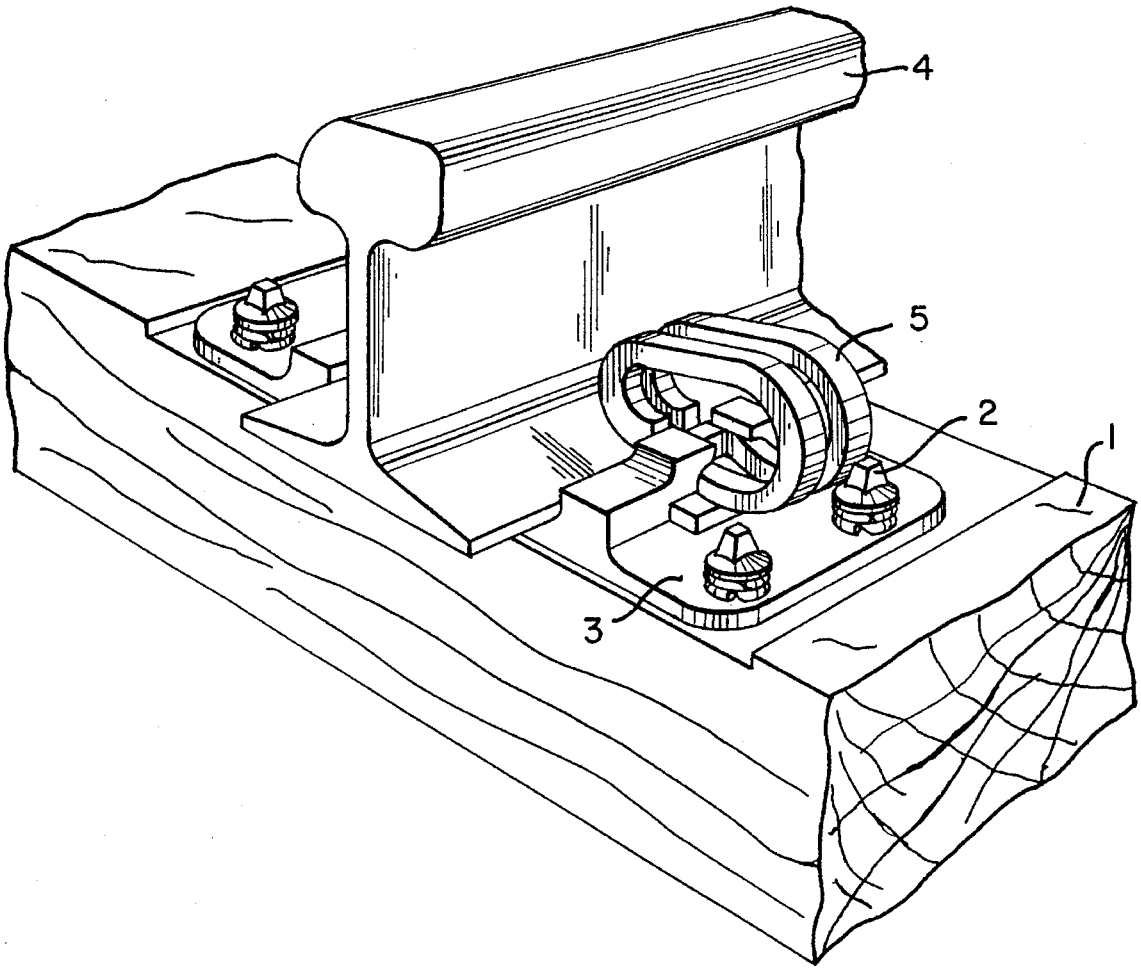
FIG. 1 has a representation in perspective of the fastening system of rails to sleepers by means of clamp and plate sets.
Figure 2:
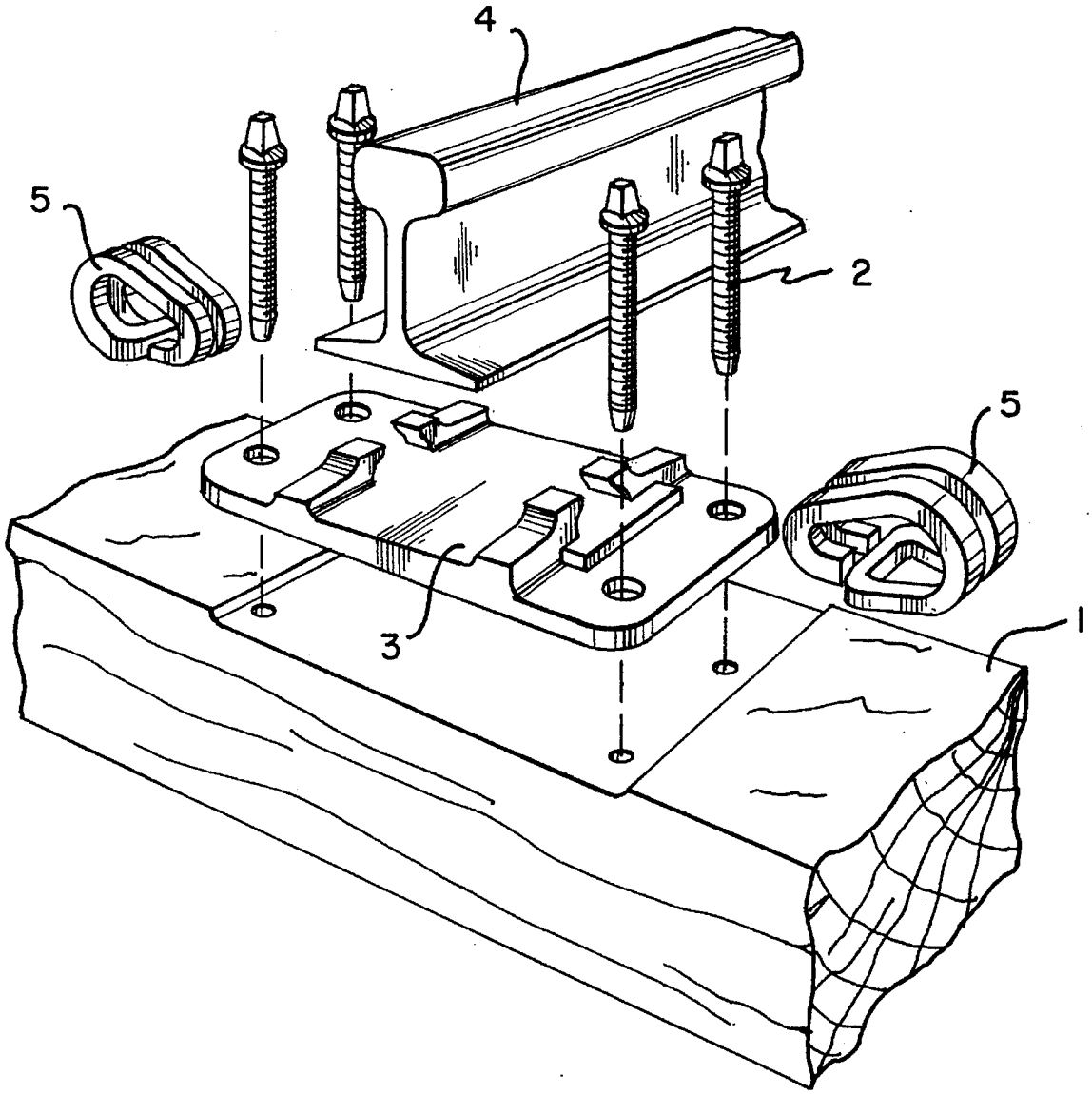
FIG. 2 is a representation in perspective similar to FIG. 1, but with the pieces disassembled so as to give an exploded view.

As shown in FIGS. 1 and 2 a stretch of rail (4) is fastened to the respective sleeper (1) by means of plate (3) screwed to sleeper (1) with bolts (2) known as tirefons. Elastic fastening clamps of the conventional shape are adjusted to each side of the rail in the corresponding notches of plate (3). As shown by FIGS. 1 and 4 the upper part of clamp (5) contacts plate (3) at only two points at which the entire load of clamp (5) on plate (3) is concentrated. At these two spots, during the life of plate (3), due to the dynamic strain to which the set is exposed and also because of installations and removals of clamp (5) for maintenance, plate (3) is worn down. As the conditions of railroad track and the rolling stock deteriorate this wear is accelerated and reduces the useful life of plate (3).

As already mentioned, this invention seeks to correct such accelerated wear of the fastening plate through a change in the shape of the contact surface between the clamp and the plate so as considerably increase the useful life of the plate, even when the set is subject to the worst operating conditions.

Clamp (5') as modified by the invention is shown in FIG. 5 where we have three views of same purposes of comparison with the conventional clamp of FIG. 4.

In FIG. 7 we likewise have three views of the clamp for comparison with the three views of the conventional clamp shown in FIG. 6.

The changes which produced clamp (5') were made in the shape of the clamp basis whose upper part received the form of an arc having approximately the same radius as the notch of plate (3), which mean that the surface if the clamp basis matches perfectly the surface in half circle of the notch in plate (3).

Another view of FIG. 5 (FIG. 5B) shows clamp (5') introduced into the notch of plate (3) with perfect adjustment between the two pieces. Thus contact of clamp (5') with plate (3) ceases to be by points as was the case with the conventional clamp—shown in FIG. 4—, but, on the contrary, involves a substantially larger surface or, in other words, practically the whole surface of the notch of plate (3) is in contact with clamp (5').

I claim:

1. A unitary clamp to fit in a part circular opening defined by two arcuate arms having a gap between their opposing ends formed on a vertical upstanding wall of a clamp plate having a base for resting on a sleeper in which the base of the clamp plate is to carry a rail that is parallel to the clamp plate upstanding wall and the clamp is to fit in said part circular opening and engage both the clamp plate and the rail, said clamp comprising:

a unitary member of two generally C shaped sections each having upper and lower curved arms joined by a central member, and a cross-connecting piece at the end of the central member at one of said upper and lower arms of each of said two sections to place said sections spaced apart and generally parallel to each other, said cross-connecting piece having a curved shape conforming to that of the part circular opening to engage the interior of the two arcuate arms of the clamp plate upstanding wall part circular opening, with one of the arms of the two clamp sections resting on the clamp plate base and the other arm of the clamp sections to rest on the rail.

2. A clamp as in claim 1 for a clamp plate with which said part circular opening has a first radius of curvature, the outer surface of said curved clamp cross-piece also being substantially of said first radius of curvature to fit into said opening and conform to and engage the inner surface of said two arcuate arms defining said opening.

3. A clamp as in claim 1 wherein said one of said arms of said sections adjacent to which the cross-piece is connected has a larger radius than the other of said arms.

4. A clamp as in claim 1 wherein said sections are curved in the area where the cross-connecting piece is connected.

* * * * *

UNITED STATES PATENT AND TRADEMARK OFFICE

CERTIFICATE OF CORRECTION

PATENT NO. : 5,522,542

DATED : June 4, 1996

INVENTOR(S) : Ezildo CIECIELSKI

It is certified that error appears in the above-indentified patent and that said Letters Patent is hereby corrected as shown below:

On the title page: Item

[30], Foreign Application Priority Data, change "9204140" to --PI 920 4140--.

Signed and Sealed this

Fifteenth Day of October, 1996

*Attest:*

Bruce Lehman

BRUCE LEHMAN

*Attesting Officer*

*Commissioner of Patents and Trademarks*